United States Patent [19]

Chu

[11] Patent Number: 4,916,588

[45] Date of Patent: Apr. 10, 1990

[54] A FLASHLIGHT WITH FOCUS AND SWITCH CONTROL

[75] Inventor: Tak Y. W. Chu, Hong Kong, Hong Kong

[73] Assignee: Akron Industrial Limited, Hong Kong, Hong Kong

[21] Appl. No.: 226,667

[22] Filed: Aug. 1, 1988

[51] Int. Cl.[4] ..... F21L 7/00

[52] U.S. Cl. ..... 362/203; 362/187; 362/207

[58] Field of Search ..... 362/157, 158, 187, 202, 362/203, 205, 207

[56] References Cited

U.S. PATENT DOCUMENTS

| | | | |
|---|---|---|---|
| 1,082,887 | 12/1913 | Maisel . | |
| 1,421,944 | 7/1922 | Humiston . | |
| 1,610,289 | 12/1926 | Jones . | |
| 1,871,389 | 8/1932 | Rathmann . | |
| 1,922,332 | 8/1933 | Shannon | 240/10.69 |
| 2,078,028 | 4/1937 | Schneider | 240/10.66 |
| 2,339,356 | 1/1944 | Sachs | 240/10.69 |
| 2,599,295 | 6/1952 | Thomas | 200/60 |
| 2,915,621 | 12/1959 | Garland | 240/10.66 |
| 2,931,005 | 3/1960 | Saurwein et al. | 339/182 |
| 3,890,498 | 6/1975 | Toth, Sr. | 240/10.66 |
| 4,286,311 | 8/1981 | Maglica | 362/205 |
| 4,388,673 | 6/1983 | Maglica | 362/183 |
| 4,398,238 | 8/1983 | Nelson | 362/187 |
| 4,429,351 | 1/1984 | Petzl et al. | 362/187 |
| 4,472,766 | 9/1984 | Hung | 362/158 |
| 4,527,223 | 7/1985 | Maglica | 362/187 |
| 4,577,263 | 3/1986 | Maglica | 362/187 |
| 4,605,994 | 8/1986 | Krieg | 362/202 |
| 4,751,621 | 6/1988 | Jenkins | 362/187 |

*Primary Examiner*—Stephen F. Husar
*Attorney, Agent, or Firm*—Reese Taylor

[57] ABSTRACT

A torch comprises a battery housing and a torch head, which torch head is relatively movable to the battery housing, and wherein the torch head is provided with means supported on its inner surface which on relative movement of the torch head to the battery housing causes movement of a battery or batteries in the battery housing away from a light bulb fixedly supported at the end of the battery housing.

13 Claims, 1 Drawing Sheet

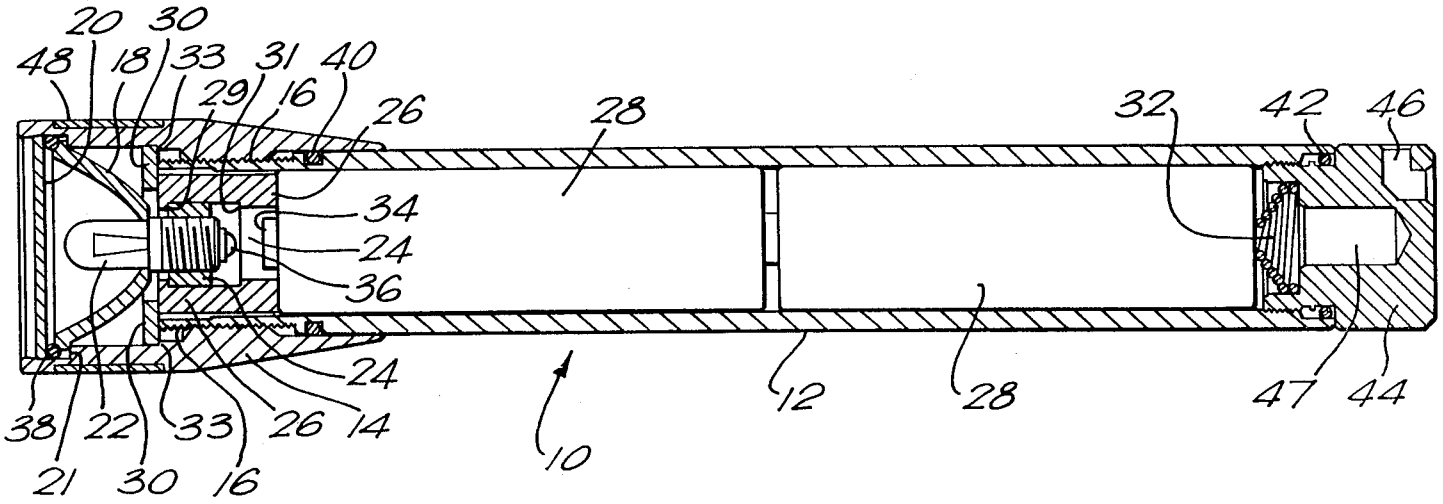
46
42
32
28
28
26
40
31
16
29
33
30
18
20
48
34
24
36
24
14
26
16
33
30
22
21
38
44
47
12
10

A FLASHLIGHT WITH FOCUS AND SWITCH CONTROL

BACKGROUND OF THE INVENTION

The invention relates to handheld torches.

In known torches, the switching mechanism to turn on and off the light is complicated in design and construction. In particular, the switching mechanism of known torches incorporate a number of small but complicated components, which are relatively difficult to manufacture, and difficult to manipulate in the assembly of a handheld torch.

SUMMARY OF THE INVENTION

In accordance with the present invention, a torch comprises a battery housing and a torch head, which torch head is relatively movable to the battery housing, and wherein the torch head is provided with means supported on its inner surface which on relative movement of the torch head to the battery housing causes movement of a battery or batteries in the battery housing away from a light bulb fixedly supported at the end of the battery housing.

Such an arrangement is extremely simple in design and construction, and in particular is simple to operate, manufacture and assemble.

The light bulb is fixedly supported at the end of the battery housing, and the arrangement is preferably such that a terminal of the light bulb is in direct contact with a terminal of the battery when the torch is in an "on" position. In an "off" position, the battery is moved away from the light bulb to disconnect the two terminals and switch off the light bulb.

A reflector is suitably provided in the torch, which is supported by the torch head, and since the head moves relative to the fixed bulb, the reflection dispersion of the light beam is varied depending on the relative position of the reflector to the light bulb.

Suitably, the means on the torch head to cause the battery to move is a circular extension secured to the inner surface of the torch head, which extension contacts at least one battery mover which actually causes movement by direct engagement of the batteries.

Suitably, the battery movers are retained within a holder for the light bulb, and in particular are retained to allow longitudinal movement only. The extension means on the battery head meanwhile is fixed to the head and therefor rotatable about the longitudinal axis of the torch, and free engagement of the circular extension with the battery movers is allowed.

BRIEF DESCRIPTION OF THE DRAWING

The FIGURE shows a cross-sectional view of a torch in accordance with the present invention.

DESCRIPTION OF THE PREFERRED EMBODIMENT

In the drawing, a torch 10 is shown comprising a battery housing 12 and a unitary torch head 14 screw threadingly engaged (see 16) at the top of the battery housing 12. In particular, a relatively short screw thread is provided on the inner surface of the torch head 14, while a relatively long counter screw thread is provided on the outer surface of the battery housing 12, such that the head 14 can move outwardly relative the battery housing by simply turning the head, causing the screw thread on the head to move outwardly on the screw thread provided on the battery housing.

A parabolic reflector 18 and a transparent lens 20 are supported inside the torch head 14 (in particular by a ledge 21 on the head 14), while a bulb 22 is fixedly supported at the other end of the battery housing 12 and extending through an aperture at the base of the reflector. On movement of the head 14 outwards from the battery housing 12, movement of the reflector 18 relative the stationary bulb 22 causes the light beam from the torch when operated to vary the reflection dispersion thereof.

The bulb 22 is screwed within a bulb holder 24 (partly hidden in the drawing), which holder is fixedly held within the outer end of the battery housing 12. This bulb holder 24 is provided with two slots in which longitudinally moveable battery movers 26 are provided to engage and move batteries 28. In particular these battery movers 26 can move from an "off" position (shown in the FIGURE) to an "on" position where the battery movers 26 extend beyond the outer end of the battery housing 12. In the "off" position, a ledge 29 on the top part of the battery movers 26 engages the top surface of the bulb holder 24, and in the "on" position a ledge 31 on the bottom part of the battery movers 26 engages the lower surface of the portion of the bulb holder 24 shown in the drawing surrounding the bulb 22.

The battery movers 26 are translated from the "on" to "off" position (and vise versa) by means of contact with extension means (in particular a ring 30 secured to a ledge 33 on the inner surface of the torch head 14). In operation, when the torch head is longitudinally moved outward from the battery housing 12, the ring 30 which is secured to the inside of the torch head 14 moves outwardly and allows the battery movers 26 to move outwardly as well. Since the batteries 28 ae sprung biased outwardly by means of spring means 32, the batteries 28 move within the battery housing towards the outer end thereof until the end cap 34 of the outermost battery contacts the end terminal 36 of the bulb 22, which causes the electrical circuit of the torch to be completed and operate the bulb 22.

When it is required to turn off the torch, the torch head 14 is screw threadingly reversed to cause the torch head 14 to move inwardly on the battery housing 12, which causes the ring 30 on the inside of the torch head 14 to move inwardly against the battery movers 26, which in turn move inwardly the batteries 28 against the spring means 12 to cause the end contact 34 of the outermost battery to disconnect from the terminal 36 of the bulb 22 to interrupt the electrical circuit of the torch. The ring 30 extends around the whole circumference of the torch head 14, in order to contact the battery movers 26 at any relative position of the torch head 14 to battery housing 12.

The torch 10 is completely water-proof due to the provision of a number of sealing means in the form of O-rings. In particular, sealing means 38 are provided between the inside of the torch head 14 and the lens 20, which sealing means 38 is held in place by the reflector 18. Sealing means 40 between the outside surface of the battery housing 12 and the inside surface of the torch head 14, and finally sealing means 42 between the inside surface of the battery housing 12 and the outside surface of an end cap 44 of the battery housing 12, are also provided.

The end cap 44 which is screw threadingly attached to the housing 12, is provided with a hole 46 in which string or the like can be connected to act as carrying means for the torch. The end cap 44 is also provided with a recess in which to support the spring means 32, which recess has an inner chamber 47 in which a replacement bulb 22 can be conveniently stored. Finally, the outside surface of the torch head 14 is provided with a hand gripping portion 48 in order to allow easy turning of the torch head 14 relative the battery housing 12.

Such a torch arrangement allows simple switching of the torch by turning of the torch head 14 relative the battery housing 12. The on/off mechanism is extremely simple in design and construction, and is furthermore effective in operation.

What is claimed is:

1. A torch comprising:

a battery housing;

a torch head, which torch head is relatively movable to said battery housing; and means supported on the inner surface of said torch head and which on relative movement of at least one battery in said battery housing cause movement of at least one battery in said battery housing away from a light bulb fixedly supported at the end of said battery housing.

2. A torch as claimed in claim 1 wherein a terminal of said light bulb is in direct contact with a terminal of said battery when the torch is in an "on" position, and wherein in an "off" position, said battery is moved away from said light bulb to disconnect the two terminals and switch off said light bulb.

3. A torch as claimed in either claim 1 or 2 wherein a reflector is provided in the torch, which is supported by said torch head, and wherein as said head moves relative to said fixed bulb, the reflection dispersion of the light beam being varied depending on said relative position of said reflector to said light bulb.

4. A torch as claimed in either claim 1 or 2 wherein said means on said torch head to cause said battery to move is a circular extension secured to the inner surface of said torch head, which extension contacts at least one battery mover which actually causes movement by direct engagement of said battery.

5. A torch as claimed in claim 4 wherein said battery movers are retained within a holder for said light bulb.

6. A torch as claimed in claim 4 wherein said battery movers are retained to allow longitudinal movement only.

7. A torch as claimed in claim 5 wherein said battery movers are retained to allow longitudinal movement only.

8. A torch as claimed in claim 4 wherein said extension means on said battery head is fixed to said head and therefore rotatable about the longitudinal axis of the torch, and wherein free engagement of said circular extension with said battery movers is allowed.

9. A torch as claimed in claim 5 wherein said extension means on said battery head is fixed to said head and therefore rotatable about the longitudinal axis of the torch, and wherein free engagement of said circular extension with said battery movers is allowed.

10. A torch as claimed in claim 6 wherein said extension means on said battery head is fixed to said head and therefore rotatable about the longitudinal axis of the torch, and wherein free engagement of said circular extension with said battery movers is allowed.

11. A torch as claimed in claim 3 wherein said means on said torch head to cause said battery to move is a circular extension secured to the inner surface of said torch head, which extension contacts at least one battery mover which actually causes movement by direct engagement of said battery.

12. A torch as claimed in claim 11 wherein said battery movers are retained within a holder for said light bulb.

13. A torch as claimed in either claim 11 or 12 wherein said battery movers are retained to allow longitudinal movement only.

* * * * *

UNITED STATES PATENT AND TRADEMARK OFFICE

CERTIFICATE OF CORRECTION

PATENT NO. : 4,916,588

DATED : April 10, 1990

INVENTOR(S) : Tak Y. W. Chu

It is certified that error appears in the above-identified patent and that said Letters Patent is hereby corrected as shown below:

On the first page of the patent, under the heading "Assignee," delete "Akron" and substitute therefor --Arkon--.

In Column 2, Line 6, delete "other" and substitute therefor --outer--.

In Column 2, Line 37, delete "ae" and substitute therefor --are--.

In Column 2, Line 50, delete "12" and substitute therefor --32--.

Signed and Sealed this

Twenty-third Day of July, 1991

*Attest:*

HARRY F. MANBECK, JR.

*Attesting Officer*

*Commissioner of Patents and Trademarks*